US010266234B2

(12) United States Patent
Ruivenkamp

(10) Patent No.: US 10,266,234 B2
(45) Date of Patent: Apr. 23, 2019

(54) SYSTEM FOR TRANSPORTING PEOPLE AND/OR FREIGHT BY MEANS OF A SHUTTLE

(71) Applicant: Hallcon B.V., Maasland (NL)

(72) Inventor: Johan Ruivenkamp, Maasland (NL)

(73) Assignee: Hallcon B.V., Maasland (NL)

( * ) Notice: Subject to any disclaimer, the term of this patent is extended or adjusted under 35 U.S.C. 154(b) by 0 days.

(21) Appl. No.: 15/689,540

(22) Filed: Aug. 29, 2017

(65) Prior Publication Data

US 2018/0057119 A1 Mar. 1, 2018

(30) Foreign Application Priority Data

Aug. 30, 2016 (NL) ..... 2017388

(51) Int. Cl.
*B63B 27/00* (2006.01)
*B63B 27/16* (2006.01)
(Continued)

(52) U.S. Cl.
CPC ..... *B63B 27/16* (2013.01); *B63B 27/30* (2013.01); *B63B 35/4413* (2013.01)

(58) Field of Classification Search
CPC ..... B63B 27/10; B63B 27/16; B63B 27/30; B63B 35/50; B63B 39/00;
(Continued)

(56) References Cited

U.S. PATENT DOCUMENTS 2,199,588 A * 5/1940 Cobham ..... B64D 39/06 244/135 A
3,737,117 A * 6/1973 Belew ..... B64G 1/646 244/137.2
(Continued)

FOREIGN PATENT DOCUMENTS

CA 2866999 A1 * 7/2014 ..... B63B 27/10
DE 10 2009 042 793 A1 3/2011
(Continued)

OTHER PUBLICATIONS

Netherlands Search Report dated May 18, 2017 in NL-2017388, filed on Aug. 30, 2016 (with English Translation of Categories of Cited Documents and Written Opinion).

*Primary Examiner* — Gregory W Adams
(74) *Attorney, Agent, or Firm* — Oblon, McClelland, Maier & Neustadt, L.L.P.

(57) ABSTRACT

A system for transporting people and/or freight includes a shuttle having, at an upper side thereof, a lock to detachably secure a hoisting cable for use in hoisting the shuttle and, on a lower side thereof with a first catch member. A shuttle landing station has a second catch member, the two catch members being at least partly complementary to each other and able to be coupled to each other. Activable stabilizers on the shuttle maintain the position of the shuttle on the landing station after the coupling of the catch members. The first catch member on the lower side of the shuttle is a cavity which tapers off to the top. The second catch member on the landing station is a convex cone detachably secured to the landing station by at least one detachable attachment element, wherein the convex cone tapers toward the first catch member when the first catch member and the second catch member are coupled. to each other.

8 Claims, 2 Drawing Sheets

(51) Int. Cl.
*B63B 27/30* (2006.01)
*B63B 35/44* (2006.01)

(58) Field of Classification Search
CPC ..... B63B 2017/0072; B63C 2009/035; B66C 13/02; B66C 23/18; B64F 1/007; G05D 3/20
See application file for complete search history.

(56) References Cited

U.S. PATENT DOCUMENTS 3,910,219 A * 10/1975 Ono ..... B63B 35/70 114/248
4,119,051 A * 10/1978 Orndorff, Jr. ..... B63B 21/60 114/249
4,180,362 A * 12/1979 Stair ..... B66D 1/52 254/279
4,271,553 A * 6/1981 Korsvik ..... B63B 27/36 114/373
4,356,784 A * 11/1982 Waters ..... B63B 35/70 114/248
4,395,178 A * 7/1983 MacDonell ..... B63B 27/30 114/259
4,646,672 A * 3/1987 Bennett ..... B63B 35/4413 114/264
5,687,668 A * 11/1997 Kawasaki ..... B63B 35/70 114/249
5,988,932 A * 11/1999 Haney ..... B63B 9/065 114/242
6,390,416 B2 * 5/2002 Holemans ..... B64G 1/641 244/173.3
6,431,105 B2 * 8/2002 Haram ..... B63B 23/32 114/201 R
6,457,432 B2 * 10/2002 Ghignone ..... B63B 27/36 114/258
7,507,055 B2 * 3/2009 Smith ..... F16L 1/202 405/173
8,807,485 B2 * 8/2014 Aston ..... B64G 1/641 244/173.3
9,821,984 B2 * 11/2017 Chin ..... B63B 27/10
9,926,048 B2 * 3/2018 Ruivenkamp ..... B63B 23/58
2006/0236912 A1 * 10/2006 Haavie ..... B63B 27/16 114/382
2015/0096485 A1 * 4/2015 Morice, III ..... B63B 27/10 114/259
2016/0068373 A1 3/2016 Chin et al.

FOREIGN PATENT DOCUMENTS

WO WO 2004/108519 A1 12/2004
WO WO-2011095316 A1 * 8/2011 ..... B63B 27/18
WO WO-2014107109 A1 * 7/2014 ..... B63B 23/58
WO WO 2014/150950 A2 9/2014

* cited by examiner

SYSTEM FOR TRANSPORTING PEOPLE AND/OR FREIGHT BY MEANS OF A SHUTTLE

BACKGROUND OF THE INVENTION

The present invention relates to a system for transporting people and/or freight. This includes in particular the transport of people and/or freight to floating objects and/or objects fixed to the bottom of the sea and or standing on the bottom of the sea, such as platforms used for the production of oil, gas or electricity.

FIELD OF THE INVENTION

A known method makes use of a helicopter for transporting in particular personnel to and fro. The use of a vessel is part of another method. However, due to the sometimes strong wave motion, the creating and maintaining of a safe footbridge between the vessel and a respective landing place is not without danger. In practice, there is a need for a system enabling the safe transport of people and/or freight.

It is an object of the present invention to provide a system enabling quick and safe transport of people and/or freight from or to a vessel or an object standing on the bottom of the sea, such as a drilling platform.

To achieve this, the system for transporting people and/or freight according to the invention comprises a shuttle which is provided on the upper side with a lock configured to detachably secure a hoisting cable for use in hoisting the shuttle, and which is provided on the lower side with a first catch member, a shuttle landing station on which a second catch member is provided, wherein said two catch members are at least partly complementary to each other and can be coupled to each other, and stabilizers which can be activated and which are constructed such that, after the coupling of the catch members, they maintain the position of the shuttle on the landing station, and which stabilizers are provided at least in part on the shuttle and/or on the landing station. The activatable stabilizers and the lock are connected to each other.

An advantage of the system according to the invention resides in that the shuttle to be lifted, whether or not accommodating people and/or freight, can be transported by a crane present at the site from a vessel to a fixed or floating object, or conversely. The shuttle can be used as a hoistable transport means and the first catch member thereof can be lowered on to the second catch member of the respective landing station. In this position the complementary catch members are connected to each other. Subsequently, the catch members and the shuttle are stabilised in position on the landing site by the activated stabilisation members, after which the shuttle is detached from the hoisting cable by the subsequently activated detachable means intended for this purpose. As a result, the shuttle is in the proper stable position, which is maintained to enable the crew to safely leave or board the shuttle. Conversely, after catching the shuttle and attaching it to the hoisting cable, the stabilisation members are deactivated, after which the shuttle can be lifted safely.

In a possible embodiment of the system according to the invention, the first catch member on the lower side of the shuttle tapers off to the bottom. The second catch member present on the landing station is complementary to the first catch member, said second catch member having a cavity which tapers off to the bottom. Said first catch member, for example, terminates in a point which enters into the complementary cavity on the landing station. The cavity which accommodates the pointed end of the shuttle may be a simple recessed part, which may be provided, for example, on the deck of a vessel, the quay or a platform at sea. After the catch members have been caught and coupled to each other, the stabilisation members are activated, causing the shuttle to remain in a stable position on the landing station. After activation of the stabilisation members, a command is directed at the detachable means connected to said stabilisation members, causing the hoisting cable to become automatically detached from the stably positioned shuttle.

Another possible embodiment of the system according to the invention is the reverse, as it were, of the abovementioned embodiment. Thus, in this embodiment, the first catch member situated on the bottom side of the shuttle is a cavity which tapers off to the top. And the second catch member situated on the landing station tapers off to the top, for example like a cone or a hemisphere. In this embodiment, the first catch member on the shuttle is in the shape of, for example, a conical cavity in which fits, for example, the spherical second catch member which terminates in a point and which is situated on the landing station. Said cavity has a recessed portion in which said point on the cone or hemisphere, which may or may not be springy in transverse direction, is caught. In this embodiment, the landing station can be fastened, preferably detachably, to the deck of the transport vessel, the quay or a platform. Also in this embodiment, after the catch members have been caught and coupled to each other, the stabilisation members are activated, causing the shuttle on the landing station to remain in a stable position.

In general, as regards the embodiments explained hereinabove, the hoist connection comprising a ball-locking mechanism situated on the top side of the shuttle and forming part of the detachable means is disconnected. Subsequently, the crew can safely board and disembark. To lift the shuttle from its position on the landing station, the crane operator is instructed to restore the connection with the shuttle by means of the ball which is located at the end of the hoisting cable and which is then lifted or inserted into the funnel situated on top of the shuttle. Next, the ball is secured in the locking mechanism, thereby restoring the connection between the hoisting cable and the shuttle. Immediately after said connection has been established, the stabilisation members are automatically deactivated. In order to carry out the abovementioned automatic processes and to give and process mutual instructions, the activable stabilisation members and the detachable means are connected to each other.

In both embodiments, the locking members can be provided at possible and/or desired locations on the shuttle, the landing station or both the shuttle and the landing station in an advantageous manner.

Further detailed, possible embodiments, which are set forth in the remaining claims, are mentioned together with the associated advantages in the following description.

BRIEF DESCRIPTION OF THE DRAWINGS

The system according to the present invention will now be explained in greater detail with reference to the figures mentioned below, in which corresponding parts are indicated by means of the same reference numerals. In the Figures.

DETAILED DESCRIPTION OF THE PREFERRED EMBODIMENT

Figure 1:
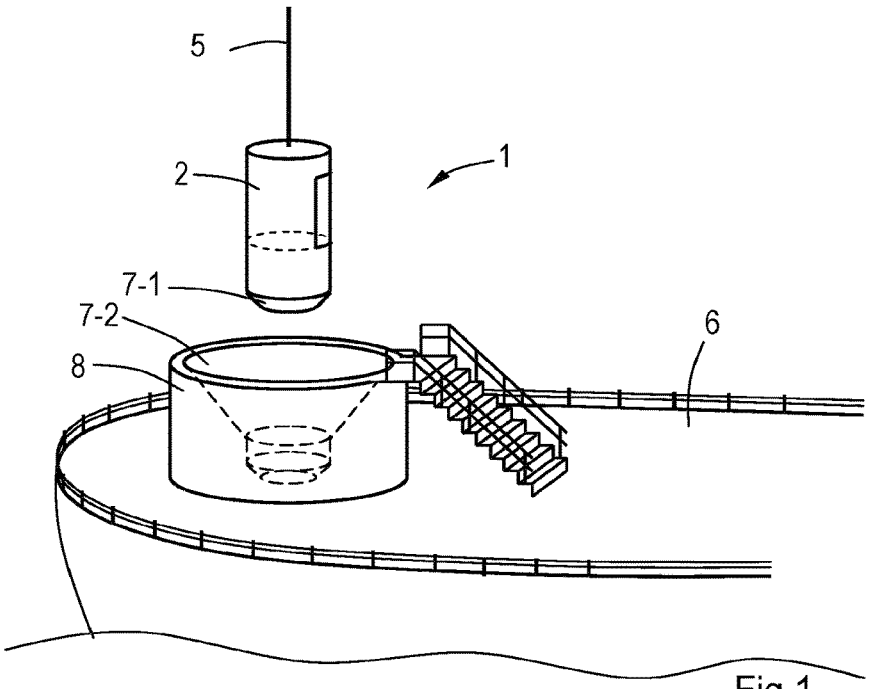
FIG. 1 shows a first embodiment of the system according to the invention, in which the shuttle is caught in a landing station which may be located on deck of a vessel or on a platform or the like, FIG. 2 shows a detail of the manner in which the system of FIG. 1 may be arranged.
Figure 2:
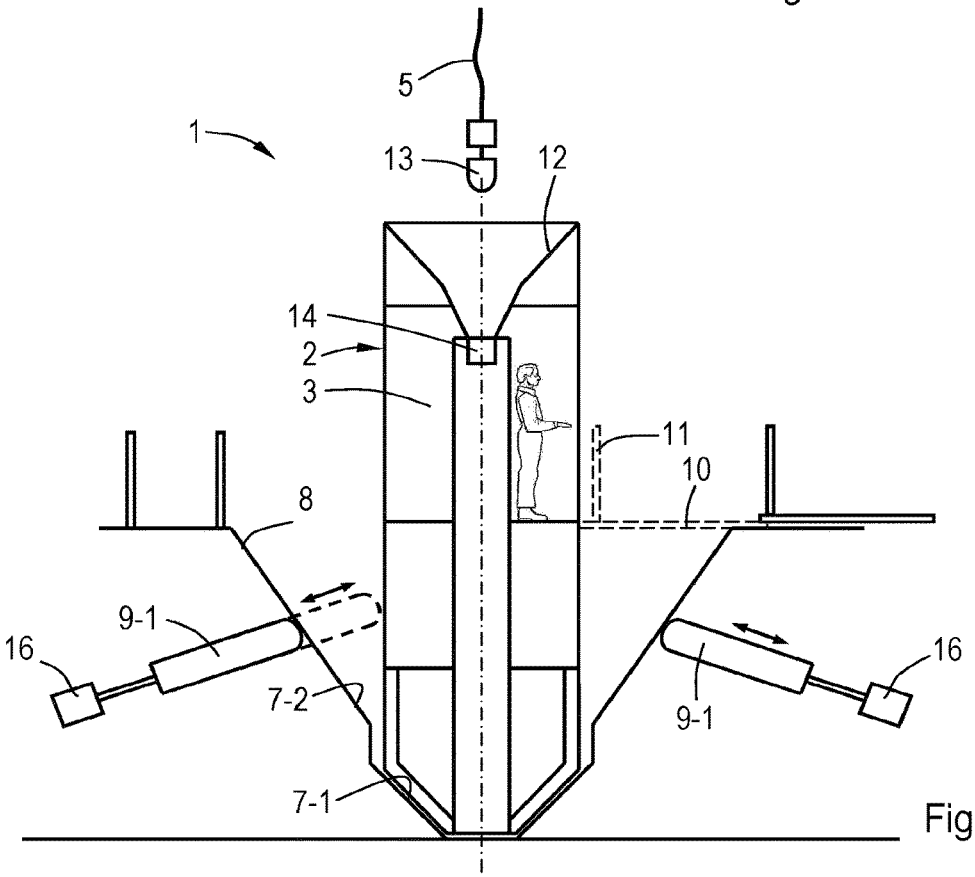
Figure 3:
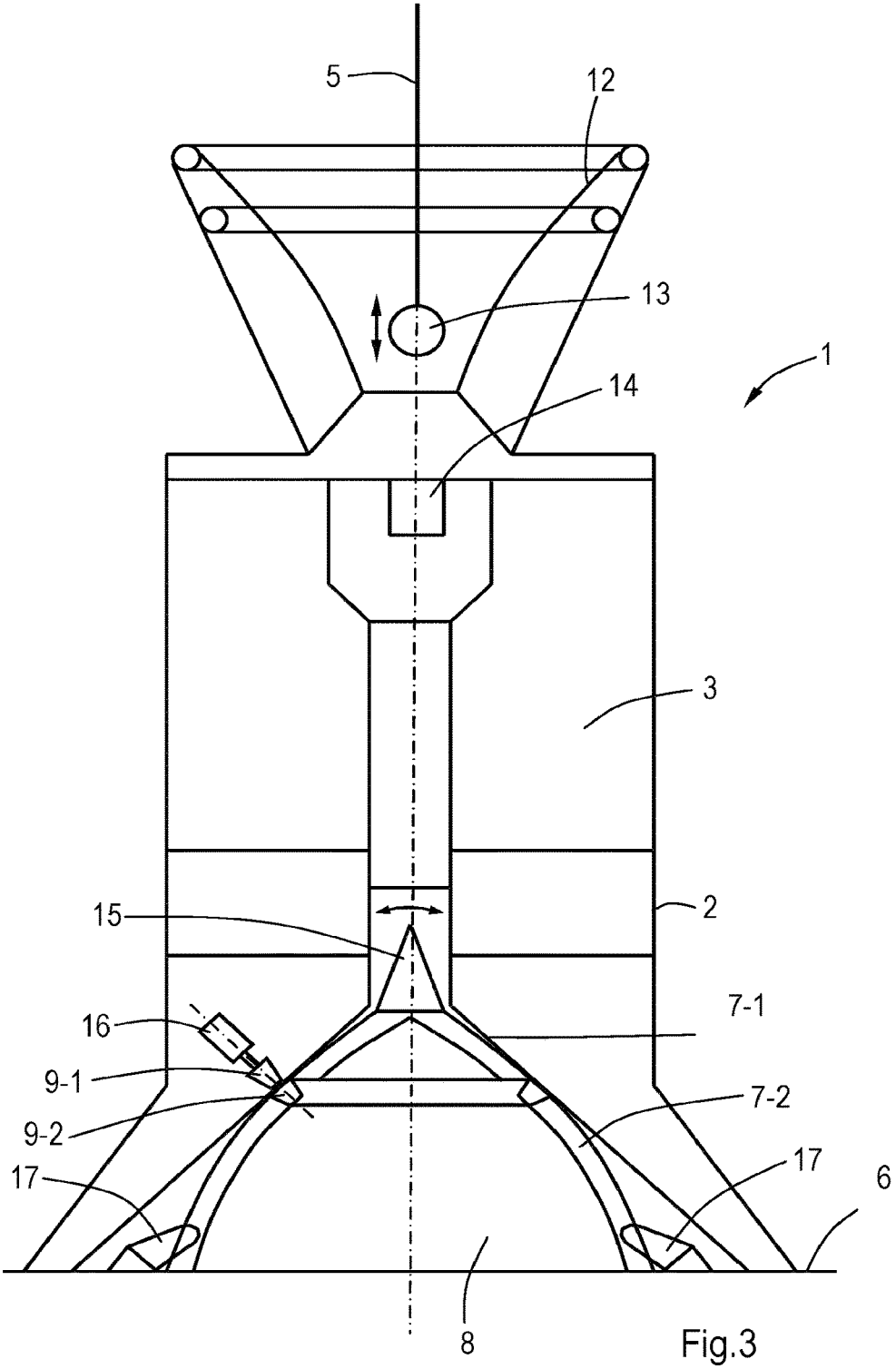
FIG. 3 shows a second embodiment of the system according to the invention.

FIGS. 1, 2 and 3 show a system 1 for transporting people and/or freight, such as supplies, foodstuffs, equipment and tools. Said system 1 comprises a shuttle 2 having, in this case, a compartment (3) for people and a cargo space underneath said compartment. Said compartment can accommodate and transport, for example, 5 to 10 people. In this case, the shuttle 2 is suspended from a hoisting cable 5 of a crane, not shown, which may be located on board of a vessel or platform or elsewhere, such as on a much larger ship. Using means 14 which will be explained in greater detail hereinafter, the crane and the shuttle 2 can be connected to one another or disconnected, as required, by, respectively, coupling said means to or uncoupling said means from a ball 13 at the end of the hoisting cable 5.

On the bottom side, the shuttle 2 is provided with a first catch member 7-1, which is shaped so as to be complementary to a second catch member 7-2. In the embodiment shown in FIGS. 1 and 2, the member 7-2 is a cavity provided on a landing station 8 of the shuttle 2, and member 7-1 is a cone or point complementary thereto, which is situated on the shuttle 2. In the embodiment shown in FIG. 3, the member 7-2 on the landing station 8 is preferably circularly symmetrical, such as a hemisphere shown here, and the internal shape of member 7-1 on the shuttle 2 is such as to be complementary thereto.

In terms of shape, both catch members 7-1, 7-2 fit together, at least partly, in both embodiments, which helps in catching and coupling both members without the need of manpower, so that both members can be easily coupled and uncoupled.

The shuttle 2 and the landing station 8 are secured or stabilised in position and their relative position is maintained by activation of stabilisation members 9-1, 9-2. These activable members are provided, according to the requirements, on the shuttle 2 (FIG. 3) and/or on the landing station 8 (FIGS. 1 and 2).

FIG. 2 shows that, in this case, the stabilisation member is constructed as activable pins 9-1, arranged on one or more sides to maintain the shuttle 2 in vertical position, which upon activation, are made to move into or out of the landing station 8 by, in general, a hydraulic system 16. After activation of the stabilisation members 9-1, thereby causing them to maintain the shuttle 2 in position, the abovementioned means 14 will, in practice automatically, receive the command to uncouple, causing the hoisting cable 5 or the, generally steel, ball or sphere 13 to be released, so that the shuttle is no longer connected to the cable 5. The pins 9-1, which have moved outwards after said activation, then stabilise the position of the shuttle 2 by counteracting the transverse movement of the shuttle.

Next, by providing a footbridge 10, 11, which is often extendable, the crew can safely walk from or to the compartment 3.

A catching basket 12 which flares out to the top makes it easier to catch a weight or ball 13 attached to the hoisting cable 5. In the case shown here, said catching basket 12 is housed in the top side of the shuttle 2. The crane operator must subsequently lower the ball 13 into the catching basket 12, and the ball, as a result of its shape, then moves to the center of the catching basket 12, where it is retained by the activable means 14 such that the shuttle 2, after the subsequent retraction of the pins 9-1, can be lifted from its position, in this case the landing station 8, by the crane operator. The shuttle 2 comprises a hydraulic system 16 which, in order to carry out said operation, is connected to the movable pins 9-1 and to the means 14.

FIG. 3 shows a second embodiment of the system 1. The operation thereof is similar to what has been described hereinabove with respect to the first embodiments of FIGS. 1 and 2. Also the abovementioned technical content-related aspects are similar. The landing station 8 shown in FIG. 3 is preferably detachably mounted on deck of a vessel 6, supply vessel, platform or the like. It is advantageously provided on deck only if personnel and/or freight must be lifted onto or off the vessel. To provide said landing station, use can be made for example of container cleats 17, diagrammatically shown, or other mounting material, which is preferably not permanently present.

In this embodiment, the first catch member, which is situated on the lower side of the shuttle 2, is a cavity 7-1 which tapers off to the top. The second catch member 7-2, which is a kind of hemisphere, is situated on the landing station 8 and tapers off to the top so as terminate in a point or cone 15. As the arrows diagrammatically show, the cone 15 may be springy in transverse direction in order to cushion any shocks when the two catch members 7-1, 7-2 approach and engage one another. In the case shown here, stabilisation members in the form of extendable pins 9-1 are provided in the shuttle 2 and stabilisation members in the form of a suitable cavity and/or groove 9-2 are provided on the landing station 8. The reverse or a combination with the foregoing is also possible of course, that is to say, pins 9-1 on the landing station 8 and the groove 9-2 in the cavity 7-1 of the shuttle 2. When use is made of a circumferential groove 9-2 extending along the outer circumference of said cone or hemisphere 7-2, the shuttle can be lowered, in any required rotational position, on to the landing station 8, after which the hydraulic system 16 is used to secure the one or more pins 9-1 in the circumferential groove 9-2, and next the means 14 connected to the system 16 and/or to the one or more pins 9-1 are operated to uncouple the shuttle 2 from the hoisting cable 5.

The invention claimed is:

1. A system for transporting people and/or freight, comprising:

a shuttle having, at an upper side thereof, a lock configured to detachably secure a hoisting cable for use in hoisting the shuttle, and wherein the shuttle is provided on a lower side thereof with a first catch member, a shuttle landing station on which a second catch member is provided, wherein said two catch members are at least partly complementary to each other and can be coupled to each other, and stabilizers which can be activated and which are constructed such that, after the coupling of the catch members, they maintain the position of the shuttle on the landing station, and which stabilizers are provided at least in part on the shuttle, wherein the first catch member on the lower side of the shuttle is a cavity which tapers off to the top, and the second catch member on the landing station is a convex cone detachably secured to the landing station by at least one attachment element, wherein the convex cone tapers toward the first catch member when the first catch member and the second catch member are coupled to each other.

2. The system according to claim 1, wherein the stabilizers comprise at least one movable pin and at least one groove on the surface of the convex cone for accommodating the pin.

3. The system according to claim 2, wherein at least one movable pin is secured on one of the shuttle and on the landing station.

4. The system according to claim 3, wherein said pin can be moved back and forth with a hydraulic system which is connected to said pin and which is provided in one of the shuttle and the landing station.

5. The system according to claim 2, wherein the groove extends circumferentially about the circumference of the convex cone.

6. The system according to claim 1, wherein the landing station is one of an integral or detachable part of the shore, the quay, and the deck of a fixed or floating frame.

7. The system according to claim 1, wherein the shuttle is provided on the top side with a catching basket which flares out to the top and which is used for catching a ball which is to be attached in a locking manner to a hoisting cable for the purpose of hoisting the shuttle.

8. The system, according to claim 1, wherein the at least one attachment element is a cleat.

* * * * *